United States Patent [19]

Macaulay

[11] 4,062,567

[45] Dec. 13, 1977

[54] DUAL SYSTEM CARBONLESS PAPER

[75] Inventor: Norman Macaulay, Tonawanda, N.Y.

[73] Assignee: Moore Business Forms, Inc., Niagara Falls, N.Y.

[21] Appl. No.: 466,910

[22] Filed: May 3, 1974

[51] Int. Cl.[2] ..... B41L 1/20

[52] U.S. Cl. ..... 282/27.5; 427/145; 427/150; 427/261; 428/307; 428/325; 428/537; 428/914

[58] Field of Search ..... 117/36.1, 36.2, 36.9, 117/36.4; 282/28 R, 9 R, 27.5; 427/146, 150, 151, 152, 153, 261, 145; 428/411, 537, 913, 914, 307, 325

[56] References Cited

U.S. PATENT DOCUMENTS

| | | | |
|---|---|---|---|
| 1,781,902 | 1/1929 | Gill, Jr. | 282/28 R |
| 2,348,128 | 5/1944 | Groak | 282/28 R |
| 3,169,880 | 2/1965 | Strauss | 117/36.3 |
| 3,535,139 | 10/1970 | Watanable et al. | 117/36.2 |
| 3,788,875 | 1/1974 | Schutzner | 117/36.2 |
| 3,809,668 | 5/1974 | Yarian | 117/36.9 X |
| 3,895,173 | 7/1975 | Adachi | 428/913 |
| 3,981,523 | 9/1976 | Maalouf | 282/27.5 |

FOREIGN PATENT DOCUMENTS

| | | |
|---|---|---|
| 2,136,695 | 12/1972 | France. |
| 1,213,142 | 11/1970 | United Kingdom. |

*Primary Examiner*—Thomas J. Herbert, Jr.
*Attorney, Agent, or Firm*—Watson, Cole, Grindle & Watson

[57] ABSTRACT

A set of carbonless recording sheets wherein each of the individual sheets of the set may be separately stacked with sheets which are identical thereto without the danger of offsetting or inadvertent reproduction occurring through that stack. The sheets become operative only when assembled into the manifolded set. The central, intermediate sheets of the manifolded set are each coated front and back with respective chemicals which are incapable of reacting with one another to produce a color. The set includes at least two different types of intermediate sheets, one of which has a front coating capable of reacting with the back coating of the other to produce a color and vice versa. Generally, the manifolded set will include a top sheet which has a back coating only, one or more intermediate sheets which have a front coating capable of reacting with the back coating of the next adjacent higher sheet to produce a color and a back coating which is capable of reacting with the front coating on the next adjacent lower sheet to produce a color, and a bottom sheet having a front coating which is reactive with the back coating of the next adjacent higher intermediate sheet to produce a color.

9 Claims, 1 Drawing Figure

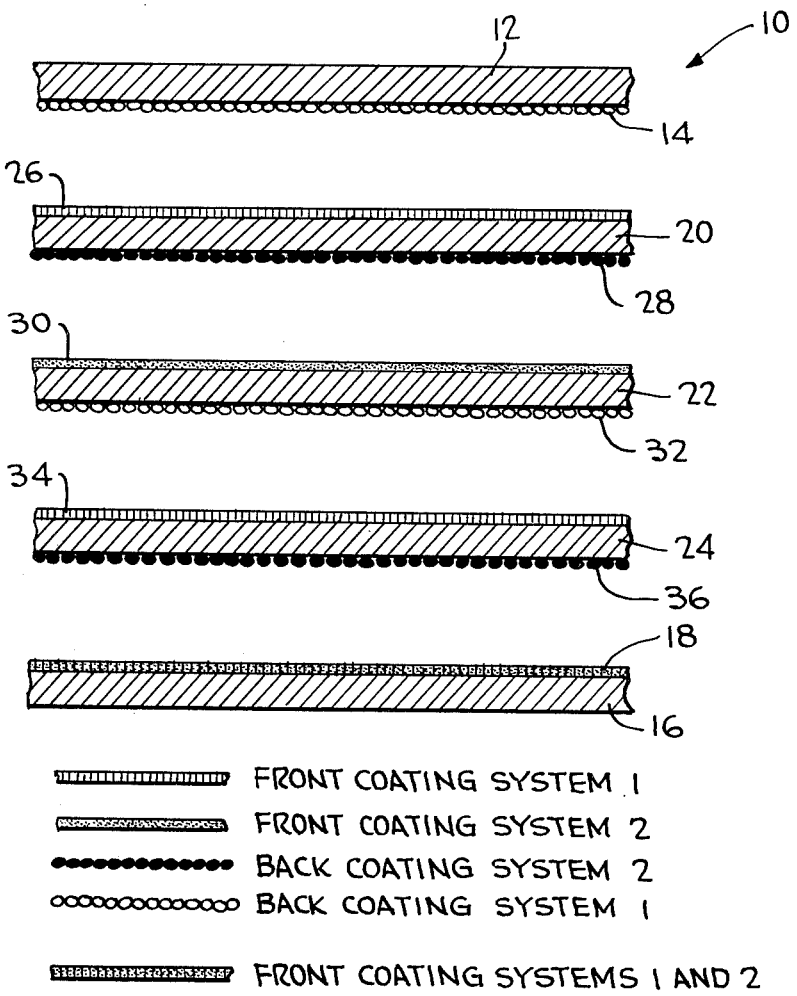
10
12
14
26
20
28
30
22
32
34
24
36
18
16
FRONT COATING SYSTEM 1
FRONT COATING SYSTEM 2
BACK COATING SYSTEM 2
BACK COATING SYSTEM 1
FRONT COATING SYSTEMS 1 AND 2

DUAL SYSTEM CARBONLESS PAPER

BACKGROUND OF THE INVENTION:

1. Field of the Invention

The present invention relates to self-marking impact papers of the transfer or manifolding type wherein one marking ingredient is carried on one sheet of paper for reaction with a second marking ingredient normally carried on a mating sheet of paper. More particularly, the present invention relates to a dual system manifolded set of marking impact transfer or manifolding papers wherein each individual paper of the set is of a construction such that identical parts when stacked one on the other provide complete elimination of inadvertent coloration or backgrounding during handling and storage, and particularly during handling and storage of the individual sheets prior to the assemblage of the same into manifolded sets.

Impact or pressure sensitive carbonless transfer papers have recently come into wide usage in the United States and throughout the world. Ordinarily, such papers are printed and collated into manifolded sets capable of producing multiple copies. In this connection, pressure applied to the top sheet causes a corresponding mark on each of the other sheets of the set.

The top sheet of paper, upon which the impact or pressure is immediately applied, ordinarily has its back surface coated with tiny microscopic capsules containing one of the reactive ingredients which produce a mark. A receiver sheet, placed in contact with such back face of the top sheet has its front surface coated with a material having a component reactive with the contents of the capsule so that when capsules are ruptured upon impact by stylus or machine key, the contents of the ruptured capsules react with a coreactant therefor on the receiver sheet and a mark forms on the receiver sheet corresponding to the mark impressed by the stylus or machine key.

In the art, impact transfer papers are designated by the terms CB, CFB and CF, which stand respectively for "coated back," "coated front and back" and "coated front." Thus, the CB sheet is usually the top sheet and the one of which the impact impression is directly made; the CFB sheets are the intermediate sheets which form a mark on the front surface thereof and also transmit the contents of ruptured capsules from the back surface thereof to the front of the next succeeding sheet; the CF sheet is the last sheet used which is only coated on the front surface to form an image thereon and is not coated on the back surface as no further transfer is desired.

While it is customary to coat the capsules on the back surface and coat the co-reactant for the capsules on the front surface of each sheet, this procedure could be reversed if desired. Further, with some systems, coatings need not be used at all and the co-reactive ingredients may be carried in the sheets themselves, or one may be carried in one of the sheets and the other may be carried as a surface coating. Further, the reactants may both be microencapsulated liquids. Patents illustrative of the various kinds of systems that may be used in the production of manifolded transfer papers are, for example, U.S. Pat. No. 1,781,902 to Gill, U.S. Pat. No. 2,168,098 to Groak, U.S. Pat. No. 2,299,694 to Green, U.S. Pat. No. 2,348,128 to Groak, U.S. Pat. No. 2,712,507 to Green, U.S. Pat. No. 2,870,040 to Gill, Jr., U.S. Pat. No. 3,016,308 to Macaulay, and U.S. Pat. No. 3,429,827 to Ruus.

The most common variety of carbonless impact transfer paper, and the type with which this invention is primarily concerned, is the type illustrated in Green ('507) and Macaulay ('308) wherein tiny microscopic capsules containing a liqid fill comprising a chemically reactive color forming dye precursor are coated on the back surface of the sheet, and a dry coating of a co-reactant chemical for the dye precursor is coated on the front surface of a receiving sheet.

Conventionally, in the past, the practice has been to utilize a series of CFB sheets which are identical with one another in the chemical system utilized in the front coating and the back coating thereof. That is to say, the back coating of each CFB sheet is reactive with the front coating of that CFB sheet to produce a color. Thus, in a stack of CFB sheets, or in a roll of CFB paper, a front coating is always in contact with a back coating which is reactive therewith and accordingly, during handling of the stack or roll of paper, inadvertent capsule rupture may occur whereby the fill contents are transferred to the adjacent coating where discoloration of the sheet occurs. Moreover, annotation of the top sheet of a stack of such CFB papers or of the outer periphery of a roll thereof would result in the production of an image on underlying sheets.

Groak ('128) discloses a copy sheet having a coloring matter on its upper surface and a transfer coating on its lower surface which transfer coating includes a solvent in which the coloring matter is insoluble. Further, Groak discloses a second copying sheet which also has its upper surface coated with a coloring matter and has a transfer coating on its lower surface. The transfer coating of the second sheet includes a solvent in which the coloring matter of the second sheet is insoluble. Thus, with either sheet, the risk of the solvent in the transfer coating penetrating through the paper and acting on the coloring matter on the upper surface is reduced. The coloring matter of the first sheet is soluble in the solvent of the second sheet and vice versa. It is to be noted that in the Groak system, a different bottom sheet would be required depending on the total number of sheets in the entire set. Thus, if a set containing six sheets were required, the top coating on the bottom sheet must be soluble in the solvent contained in the lower surface of the fifth sheet whereas if the set includes seven sheets, the coloring matter in the coating on the upper surface of the seventh sheet must be soluble in the solvent in the transfer coating on the lower surface of the sixth sheet. Manifestly, this would require the utilization of a different bottom sheet depending on the total number of sheets in the set. It is also to be noted that the problem solved by Groak, that is penetration of one reactant through the carrier sheet to cause coloration of that same sheet, is not significant in connection with papers which include a microencapsulated reactant.

SUMMARY OF THE INVENTION

It is the object of the present invention to provide a manifolded set comprising at least one CFB sheet having front and back coatings thereon which are not capable of reacting with one another to produce a color whereby such CFB sheets may be stacked without danger of inadvertent coloration during handling and storage. Further, a roll of paper from which such CFB sheets are cut would also be capable of withstanding handling and storage without coloration due to inadvertent capsule rupture in view of the fact that the reactant within the capsules is not capable of reacting with the reactant with which it is in contact during such storage. Additionally, free fill from ruptured capsules in a roll is harmlessly removed and absorbed into the unreactive CF without discoloration, thus eliminating the probability of free fill migrating to the reactive contacting CF surface when combined into a manifolded set.

Another object of the present invention is to provide a manifolded set comprising a first CFB sheet having front and back coatings thereon which are not capable of reacting with one another to produce a color, and a second CFB sheet which likewise has front and back coatings thereon which are incapable of reacting with one another to produce a color, but wherein the back coating of the first sheet and the front coating of the second sheet are capable of reacting with one another to produce a color. Thus, the individual sheets can be stacked without danger of premature color due to inadvertent capsule rupture; however, when the sheets are alternately disposed in a manifolded set, the same provide an operable color forming system.

A very important object of the present invention is to provide a manifolded set which includes at least two coloring systems as described above and wherein the bottom sheet contains a top layer which is capable of reacting with the back coating in either of the color forming systems whereby the bottom sheet in manifolded sets containing either even or odd numbers of sheets is always the same.

The shortcomings of the prior art described above are substantially overcome and the objects of the invention as set forth in the preceding paragraphs are substantially achieved through the use of a manifolded set of carbonless recording sheets comprising a top sheet having a back coating thereon, a bottom sheet having a front coating thereon, and at least one intermediate sheet having both a front coating and a back coating thereon disposed between said top and bottom sheets. The sheets are collated such that each of the back coatings is disposed in overlying and contacting relationship with respect to the front coating of the next lower adjacent sheet of the set and each of the coatings includes a color forming reactive material. The reactive material in each of the back coatings is capable of reacting with the reactive material in the front coating in contact therewith when pressed thereagainst to produce a colored mark. The reactive material in the back coating of each of the intermediate sheets is incapable of reacting with the reactive material in the front coating of the same intermediate sheet to produce a colored mark. In accordance with one major aspect of the invention, the reactive material in the front coating of the bottom sheet is capable of reacting with the reactive material in the back coating of any of the other sheets of the set to produce a colored mark when pressed thereagainst. Accordingly, no matter how many intermediate sheets are utilized in the set, the bottom sheet of each set is identical.

In a more specific embodiment of the manifolded set of sheets of the present invention, at least two intermediate sheets are included. More specifically, in the embodiment wherein at least two intermediate sheets are included in the set, the reactive material in the back coating of the top sheet comprises a first initially colorless reactive component of a first initially colorless reaction system. The reactive material in the front coating of the first one of the intermediate sheets which is next adjacent to said top sheet comprises a second initially colorless reactive component of said first reaction system, said first and second reactive components of said first reaction system being reactable when brought into contact with one another to produce a colored mark. The reactive material in the back coating of said first intermediate sheet comprises a first initially colorless reactive component of a second initially colorless reaction system and the reactive material in the front coating of a second one of said intermediate sheets, which is next adjacent to said first intermediate sheet, comprises a second initially colorless reactive component of said second reaction system. The first and second reactive components of the second reaction system are also reactable when brought into contact with one another to produce a colored mark. In accordance with the invention, however, the first component of the first system is incapable of reacting with the second component of the second system to produce a colored mark and the first component of the second system is incapable of reacting with the second component of the first system to produce a colored mark.

In a further more specific aspect of the invention, the reactive material in the back coating of the second intermediate sheet comprises the first reactive component of the first reaction system and the reactive material in the front coating of the bottom sheet comprises both of said second components.

In yet another even more specific aspect of the invention, the manifolded set of sheets includes more than two of said intermediate sheets, all odd numbered intermediate sheets being the same as said first one thereof and all even numbered intermedate sheets being the same as said second one thereof.

In another major aspect of the invention, the shortcomings of the prior art are substantially overcome and the objects of the invention are substantially achieved through the use of a manifolded set of carbonless recording sheets comprising a top sheet having a back coating thereon, a bottom sheet having a front coating thereon, and at least one intermediate sheet having both a front coating and a back coating thereon disposed between said top and bottom sheets. Each of the coatings includes a color forming reactive material and at least one of the front and back coatings includes a multiplicity of pressure rupturable microcapsules containing the color forming reactant material. The reactive material in each of the back coatings is capable of reacting with the reactive material in the front coating in contact therewith to produce a colored mark when pressed thereagainst with sufficient pressure to rupture the microcapsules. The reactive material in the back coating of each of the intermediate sheets is incapable of reacting with the reactive material in the front coating of the same intermediate sheet to produce a colored mark.

BRIEF DESCRIPTION OF THE DRAWINGS

The single FIGURE is an elevational, exploded, cross-sectional view of a manifoled set of carbonless recording sheets which embodies the principles and concepts of the present invention.

DESCRIPTION OF THE PREFERRED EMBODIMENT

A manifold set of carbonless recording sheets which embodies the principles and concepts of the present invention is illustrated in the single Figure of the drawings and is broadly designated by the reference numeral 10. Set 10 includes a top or CB sheet 12 which has a back coating 14 thereon. Set 10 also includes a bottom or CF sheet 16 having a front coating 18 thereon. As illustrated in the Figure, set 10 also includes intermediate or CFB sheets 20, 22 and 24. Sheet 20 has a front coating 26 and a back coating 28 thereon, sheet 22 has a front coating 30 and a back coating 32 thereon while sheet 24 has a front coating 34 and a back coating 36 thereon, and as can be seen in the drawings, intermediate sheets 20, 22 and 24 are disposed between top sheet 12 and bottom sheet 16. Each of the sheets 12, 20, 22, 24 and 16 are manifolded such that each of the back coatings 14, 28, 32 and 36 is disposed in overlying and contacting relationship with respect to a corresponding front coating 26, 30, 34 and 18 of the next adjacent sheet in the set. Each of the coatings 14, 26, 28, 30, 32, 34, 36 and 18 includes a color forming reactive material and the reactive material in each of the back coatings 14, 28, 32 and 36 is capable of reacting with the reactive material in the corresponding front coating 26, 30, 34 and 18 in contact therewith when pressed thereagainst to produce a colored mark. The reactive material in the back coating 28, 32 and 36 of each intermediate sheet 20, 22 and 24 is incapable of reacting with the reactive material in the respective front coating 26, 30 and 34 of the same intermediate sheet 20, 22 and 24 to produce a colored mark. However, the reactive material in the front coating of bottom sheet 16 may be capable of reacting with the reactive material in the back coating 14, 28, 32 and 36 of any of the other sheets 12, 20, 22 and 24 of the manifolded set 10 to produce a colored mark when pressed thereagainst.

As can be seen in the drawing, manifolded set 10 comprises 5 sheets including 3 intermediate sheets. In accordance with the broader aspects of the invention, set 10 could include only sheets 12, 20 and 16. Moreover, as can be seen from the drawing, sheets 20 and 24 are identical and the set could be enlarged to include more sheets by adding sheets in sequence, that is to say, a 6 sheet set would include another sheet identical to sheet 22 between sheet 24 and 16. Then if a seven sheet set is desired, another sheet identical to sheet 24 would be placed between the first added sheet, which is identical to sheet 22, and sheet 16. Thus, the manifolded set could be expanded to include any number of sheets, the only requirement being that the added sheets would alternately be sheets identical with sheet 20 and sheets identical with sheet 22.

More specifically, the reactive material in back coating 14 of top sheet 12 comprises a first initially colorless reactive component of a first initially colorless reaction system. Further, the reactive material in the front coating 26 of intermediate sheet 20 comprises a second initially colorless reactive component of the first reaction system, and it is to be understood that the reactive component in coating 14 and the reactive component in coating 26, which comprises the first reaction system, are reactable when brought into contact with one another by pressure to produce a colored mark. The reactive material in the back coating 28 of sheet 20 comprises a first initially colorless reactive component of a second initially colorless reaction system and the reactive material in the front coating 30 of sheet 22 comprises the second initially colorless reactive component of the second reaction system. Again it should be understood that the reactive component in coating 28 and the reactive component in coating 30, which comprise the second reaction system, are also reactable when brought into contact with one another by pressure to produce a colored mark. Continuing on this same basis, the reactive component in back coating 32 of sheet 22 may be the same as the reactive component in the back coating 14 on sheet 12 and the reactive component in front coating 34 of sheet 24 may be the same as the reactive component in front coating 26 on sheet 20. Thus, it should be understood that in connection with this embodiment of the invention, sheets 20 and 24 are identical and are completely interchangeable.

In accordance with the invention, the reactive component in coating 32 of sheet 22, which comprises the first component of the first reaction system, is incapable of reacting with the reactive component in the coating 30 on sheet 22 which comprises the second component of the second reaction system. Further, the reactive component in back coating 28 of sheet 20, which comprises the first component of the second reaction system is incapable of reacting with the reactive component in the front coating 26 of sheet 20, which comprises the second component of the first reaction system. Thus, the reactive component in the coating 36 of sheet 24 is incapable of reacting with the reactive component in front coating 34 of that same sheet 24. Also, the reactive component in the back coating 32 of sheet 22 is incapable of reacting with the reactive component in front coating 30 of that same sheet 22. Accordingly, a stack of sheets identical to sheet 24 would have a coating 36 in contact with a coating 34 and these two coatings include components which are incapable of reacting with one another. Hence, the sheets would not become discolored even though many of the microcapsules were inadvertently ruptured during handling. Moreover, annotation of the top sheet of such a stack with pencil or ball point pen would not result in an image being produced down through the stack, as would be the case with a single system CFB. Generally speaking, a specific part designated for example "Accounting Copy" is routed to the assigned department, which inevitably adds notation. With the dual system the top sheet can be annotated without prior removal from the stack.

As can be seen in the drawing, the first coating 18 of bottom sheet 16 may comprise a mixture of the second component of the first reaction system and the second component of the second reaction system. Accordingly, the reactive material in coating 18 is capable of reacting both with the reactive material in coating 36 of sheet 24 and with the reactive material in coating 32 of sheet 22. Thus, no matter how many sheets are included in the set, the reactive components in coating 18 of sheet 16 would be able to react with the reactive component in the back coating of the lowermost intermediate sheet.

The present invention contemplates the use of a manifolded set of sheets wherein two different chemical reaction systems are utilized. Thus, the intermediate sheets would be either like sheet 20 or like sheet 22 and it can be seen that no matter how many intermediate sheets are utilized, all even numbered intermediate sheets will be the same as sheet 20 and all odd numbered intermediate sheets will be the same as sheet 22. Moreover, as will be understood by those skilled in the art, three incompatible color forming systems could be utilized and in that case sheets 20 and 24 would be dissimilar. In such embodiment, the reactant in coating 28 would be reactive to form a color with the reactant in coating 30 but would be non-reactive with respect to the reactant in coating 26. The reactant in coating 32 would be reactive to form a color with the reactant in coating 34 but would be non-reactive with the reactant in coating 30 and the reactant in coating 36 would be non-reactive with the reactant in coating 34. Further, the reactant in coating 36 would be different from the reactant in coating 28 and the reactant in coating 34 would be different from the reactant in coating 26. Also, coating 18 could then include a mixture of reactants capable of reacting with the reactant in coating 36, the reactant in coating 32 and the reactant in 28. Similarly, sets including four or five or six or even more different color systems could be utilized in connection with the present invention, the only requirement being that the reactant in the front coating of any sheet is non-reactive to form a color with the reactant in the back coating of that same sheet.

Many color precursors useful in connection with carbonless copying systems are known to those skilled in the art to which the present invention pertains. For example, specific reference is made to the color precursors mentioned in the patent to Phillips, Jr. et al, U.S. Pat. No. 3,455,721 and particularly to those listed in the paragraph bridging columns 5 and 6 thereof. These materials are capable of reacting with an acidic coating such as kaolin clay or the acid-reactant organic polymeric material disclosed in the '721 patent. In this connection it should be understood that a myriad of patents have been previously issued in connection with initially colorless color precursors useful in connection with carbonless copying systems and the present invention depends in no way upon the exact identity or nature of the reactants utilized other than that at least two systems are required, with the first component of the first system being incompatible to produce a color with the second component of the second system and with the second component of the first system being incompatible to produce a color with the first component of the second system. For one of the systems, any of the materials disclosed in the '721 patent referred to above, which are capable of undergoing an acid-base type reaction with an acidic material, may be utilized. Also operable in connection with this first system are the spiro-dipyran compounds disclosed in the patent to Harbort, U.S. Pat. No. 3,293,060 with specific reference being made to the disclosure of the '060 patent extending from column 11, line 32 through column 12, line 21. The color precursors of Harbort, as well as the color precursors of Phillips, Jr. et al are initially colorless and are capable of becoming highly colored when brought into contact with an acidic layer such as an acid activated clay or an acid-reacting polymeric material, or the like. Manifestly, while the Harbort and Phillips, Jr. disclosures are specifically incorporated herein by reference, there are also many other examples of similar color precursors capable of undergoing a reaction with an acidic coating to produce a color.

Generally speaking, the color precursor materials of the type disclosed by Phillips, Jr. et al ('721) and by Harbort ('060) are dissolved in a solvent and the solution is encapsulated in accordance with the procedures and processes described and disclosed by Macaulay ('308) and by Green ('507) as mentioned above. Other processes for encapsulating color precursors are disclosed in U.S. Pat. No. 3,429,827 to Ruus and U.S. Pat. No. 3,578,605 to Baxter. In this connection, it should be mentioned that the exact nature of the capsule itself is not critical so long as the same is capable of containing the color precursor and can be ruptured by the application of pressure in accordance with conventional carbonless copying procedures. It should be noted in this regard that the solvents which are useful in connection with dissolving color precursors include chlorinated biphenyls, vegetable oils (castor oil, coconut oil, cotton seed oil, etc.), esters (dibutyl adipate, dibutyl phthalate, butyl benzyl adipate, benzyl octyl adipate, tricresyl phosphate, trioctyl phosphate, etc.), petroleum derivatives (petroleum spirits, kerosene, mineral oils, etc.), aromatic solvents (benzene, toluene, etc.), silicone oils, or any combination of the foregoing. With regard to the acidic coatings capable of converting the color precursors into their highly colored form, specific reference is made to the coatings disclosed in U.S. Pat. No. 3,622,364, U.S. Pat. No. 3,330,722, U.S. Pat. No. 3,389,007 and U.S. Pat. No. 3,293,060.

In the color forming systems outlined above, as will be appreciated by those skilled in the art, the color precursors are conventionally contained in pressure rupturable microcapsules which are included in the back coatings of the sheets of carbonless copying manifolded sets. Further, it will be appreciated that the acidic coatings are generally utilized as front coatings with the color precursor material in a solvent therefor being transferred from an adjacent back coating to the acidic layer front coating upon rupture of the capsules which contain the color precursor material.

For examples of a second initially colorless reaction system whose individual components are non-reactive with the acid-base type reactants set forth above, reference is made to the patents to Ostlie, U.S. Pat. No. 3,481,759 and to Matson, U.S. Pat. No. 3,516,846 and U.S. Pat. No. 3,516,941. The systems disclosed in the foregoing patents include a dithiooxamide compound as one component and a metal rosinate, particularly nickel rosinate, as the other component. Generally speaking, the dithiooxamide material is incorporated into a suitable solvent therefor, such as cyclohexene, and is microencapsulated. The rupturable microcapsules containing the dithiooxamide fill material are then utilized as the back coating in a carbonless copying system. The metal rosinate salt is used as a front coating and the two materials react to present a vivid mark. The color systems disclosed in the Ostlie ('759) and Matson ('846 and '941) patents referred to above are extremely useful in connection with the present invention in combination with the systems disclosed in the Phillips, Jr. et al ('721) and Harbort ('060) patents in view of the fact that the Phillips, Jr. et al and Harbort color precursors are not reactable with metallic rosinates to form a color and the dithiooxamides of Ostlie and Matson are not reactable with acidic coating layers, such as kaolin clay and acidic polymeric materials, to produce a color. Other patents which disclose dithiooxamide color forming systems are U.S. Pat. Nos. 3,287,154, 3,437,677 and 3,558,341.

Other initially colorless color forming systems which should be useful in connection with the present invention include an alkali metal gallate-iron lactate salt system as disclosed in U.S. Pat. No. 2,870,040; a system wherein an acid ester substituted polyhydric phenol is reacted with an iron or vanadium compound to produce a highly colored chelated compound as disclosed in U.S. Pat. No. 3,535,139; a system wherein an organovanadium compound is reacted with an aromatic hydroxy compound as disclosed in U.S. Pat. No. 3,592,677 and U.S. Pat. No. 3,632,617; systems wherein phloroglucinol, 3-hydroxyphenyl urea, aniline hydrochloride, 4-aminophenylglycine hydrochloride, N,N-dimethyl-p-phenylene-diamine hydrochloride, 3-aminopyridine, skatole, 3,4-dimethyl-5-pyrazolone, 2-methylindole, or cobalt thiocyanate is reacted with lignin to form a visible reaction product as disclosed in U.S. Pat. No. 3,450,553; and systems wherein an alkali metal or ammonium iodide solution is applied to a surface containing a color forming iodine-reactive substance and an agent for releasing iodine from the iodine solution, as disclosed in U.S. Pat. No. 3,677,786. Another system which has been found to be operable in accordance with the present invention in connection with a Lewis acid-Lewis base reaction system is a system wherein diphenyl carbazide is reacted with nickel stearate.

Thus, in accordance with the foregoing, and as specific exemplification of the present invention, in set 10, coatings 14 and 32 would include microcapsules containing a fill material comprising an initially colorless color precursor selected from among those disclosed in the paragraph bridging columns 5 and 6 of U.S. Pat. No. 3,455,721. Coatings 26 and 34 would then include a color forming reactant material such as the acid treated clay disclosed in U.S. Pat. No. 3,622,364 or the acidic polymeric materials dislosed in U.S. Pat. No. 3,455,721. Coatings 28 and 36, then, would comprise microcapsules containing a liquid fill including a dithiooxamide material such as one of those disclosed in U.S. Pat. Nos. 3,516,846 and 3,516,941. Finally, coating 30 would include a color reactant material comprising a metallic rosinate salt. In this embodiment, coating 18 preferably includes both an acidified clay material and a metallic rosinate material whereby the same is reactive with either the fill material from the microcapsules of coating 36 or the fill material of the microcapsules of coating 32.

As has been indicated above, the only critical factor involved in the present invention is that the first component of the first system be non-reactive with the second component of the second system and that the second component of the first system be non-reactive with the first component of the second system. In all other respects, the invention is contemplated as including any color forming systems which meet these requirements. Manifestly, the only basis for choosing between one or another of the various chemical reactants disclosed above is the color desired in the final copy produced by the colorless copying system.

The following is a specific example of a stacked set of carbonless recording sheets which embodies the present invention. With particular reference to the Drawing, the coating 14 comprises crystal violet lactone which is dissolved in a suitble solvent therefor and is encapsulated. Specifically, the coating 14 is prepared in accordance with Example 1 of U.S. Pat. No. 3,672,935 which describes the chromogenic material, the solvent, the method of encapsulation and the method for coating a sheet of paper with the microcapsules thus produced. The coating 26 of the Drawing is also completely described in this same Example 1 of U.S. Pat. No. 3,672,935 as comprising a polymeric material produced from paraphenylphenol and formaldehyde. The method for producing the polymeric material and the method for coating the surface of a sheet of paper therewith is described.

The coating 28 of the sheet 20 comprises a dithiooxamide material as described in Example 18 of U.S. Pat. No. 3,516,846. This dithiooxamide material is dissolved in an appropriate solvent as is also described in Example 18 of U.S. Pat. No. 3,516,846 and the capsule fill is microencapsulated and the microcapsules are coated onto a sheet of paper in accordance with Example 19 of U.S. Pat. No. 3,516,846. Front coating 30 of sheet 22 comprises nickel rosinate. The sheet 22 is coated with the coating 30 by forming a solution of nickel rosinate which is applied to the surface of sheet 22 and the solvent removed by drying to leave the required residue.

The surface 32 on the back of sheet 22 is identical with the coating 14 on the back of sheet 12. Likewise, the coating 34 on the front of sheet 24 is identical with the coating 26 on the front of sheet 20. Further, the coating 36 on the back of sheet 24 is identical with the coating 28 on the back of sheet 20.

The coating 18 on the front of sheet 16 includes both the polymeric material of coatings 34 and 26 and the nickel rosinate of coating 30. In the production of the coating 18, a coating of polymeric material is applied to sheet 16 in accordance with Example 1 of U.S. Pat. No. 3,672,935. Thereafter, a solution of nickel rosinate is applied to the polymeric coating and allowed to dry.

Manifestly, as would be well understood by those skilled in the art, in view of the fact that the coating 18 is reactive with either the dithiooxamide material of coating 32 or the crystal violet lactone of coatings 28 and 36, any number of sheets may be included in the manifolded set by first adding a sheet such as the sheet 22 between sheets 24 and 16. Then sheets such as 20 and sheets such as sheet 22 can be included alternatively and it does not make any difference which sheet is adjacent sheet 16 in view of the fact that the coating 18 is reactive with either the crystal violet lactone or the dithiooxamide material.

I claim:

1. A manifolded set of carbonless recording sheets comprising:

a top sheet having a back coating thereon;

a bottom sheet having a front coating thereon; and at least one intermediate sheet having both a front coating and a back coating thereon disposed between said top and bottom sheets, said sheets being collated such that each of said back coatings is disposed in overlying and contacting relationship with respect to the front coating of the next adjacent sheet of the set, each of said coatings including a color forming reactive material, the reactive material in each of said back coatings being capable of reacting with the reactive material in the front coating in contact therewith when pressed thereagainst to produce a colored mark, the reactive material in the back coating of each of said intermediate sheets being incapable of reacting with the reactive material in the front coating of the same intermediate sheet, to produce a colored mark, the reactive material in the front coating of said bottom sheet being reactive with the reactive material in the back coating of any of the other sheets of the stacked set to produce a coloed mark when pressed thereagainst.

2. A set of sheets as set forth in claim 1 wherein is included at least two of said intermediate sheets.

3. A set of sheets as set forth in claim 2 wherein:

the reactive material in the back coating of said top sheet comprises a first initially colorless reactive component of a first initially colorless reaction system;

the reactive material in the front coating of a first one of said intermediate sheets which is next adjacent to said first sheet comprises a second initially colorless reactive component of said first reaction system, said first and second reactive components of said first reaction system being reactable when brought into contact with one another to produce a colored mark;

the reactive material in the back coating of said first intermediate sheet comprises a first initially colorless reactive component of a second initially colorless reaction system; and the reactive material in the front coating of a second one of said intermediate sheets which is next adjacent to said first intermediate sheet comprises a second initially colorless reactive component of said second reaction system, said first and second reactive components of said second reaction system being reactable when brought into contact with one another to produce a colored mark, said first component of the first system being incapable of reacting with the second component of the second system to produce a colored mark and said first component of the second system being incapable of reacting with the second component of the first system to produce a colored mark.

4. A manifolded set of carbonless recording sheets comprising:

a top sheet having a back coating thereon;

a bottom sheet having a front coating thereon; and at least two intermediate sheets having both a front coating and a back coating thereon disposed between said top and bottom sheets, said sheets being collated such that each of said back coatings is disposed in overlying and contacting relationship with respect to the front coating of the next adjacent sheet of the set, each of said coatings including a color forming reactive material, the reactive material in the back coating of said top sheet comprises a first initially colorless reactive component of a first initially colorless reaction system;

the reactive material in the front coating of a first one of said intermediate sheets which is next adjacent to said first sheet comprises a second initially colorless reactive component of said first reaction system, said first and second reactive components of said first reaction system being reactable when brought into contact with one another to produce a coloed mark;

the reactive material in the back coating of said first intermediate sheet comprises a first initially colorless reactive component of a second initially colorless reaction system; and the reactive material in the front coating of a second one of said intermediate sheets which is next adjacent to said first intermediate sheet comprises a second initially colorless reactive component of said second reaction system, said first and second reactive components of said second reaction system being reactable when brought into contact with one another to produce a colored mark, the reactive material in the back coating of said second intermediate sheet comprises said first reactive component of said first reaction system, said first component of the first system being incapable of reacting with the second component of the second system to produce a colored mark and said first component of the second system being incapable of reacting with the second component of the first system to produce a colored mark, the reactive material in the front coating of said bottom sheet comprises both of said second components and is reactive with the reactive material in the back coating of any of the other sheets of the stacked set to produce a colored mark when pressed thereagainst.

5. A set of sheets as set forth in claim 4 wherein is included more than two of said intermediate sheets, all odd numbered intermediate sheets being the same as said first one thereof and all even numbered intermediate sheets being the same as said second one thereof.

6. A manifolded set of carbonless recording sheets comprising:

a top sheet having a back coating thereon;

a bottom sheet having a front coating thereon; and at least one intermediate sheet having both a front coating and a back coating thereon disposed between said top and bottom sheets, each of said coatings including a color forming reactive material and at least one of said front and back coatings including a multiplicity of pressure rupturable microcapsules containing the color forming reactive material thereof, said sheets being collated such that each of said back coatings is disposed in overlying and contacting relationship with respect to the front coating of the next adjacent sheet of the set, the reactive material in each of said back coatings being reactive with the reactive material in the front coating in contact therewith to produce a colored mark when pressed thereagainst with sufficient pressure to rupture the microcapsules, the reactive material in the back coating of each of said intermediate sheets being incapable of reacting with the reactive material in the front coating of the same intermediate sheet to produce a colored mark, and the reactive material in the front coating of said bottom sheet comprising both of said second components and being reactive with the reactive material in the back coating of any of the other sheets of the stacked set to produce a colored mark when pressed thereagainst.

7. A set of sheets as set forth in claim 6 wherein there is included at least two of said intermediate sheets.

8. A set of sheets as set forth in claim 7, the reactive material in the back coating of said top sheet comprising said microcapsules containing a first initially colorless reactive component of a first initially colorless reaction system;

the reactive material in the front coating of a first one of said intermediate sheets which is next adjacent to said first sheet comprising a second initially colorless reactive component of said first reaction system, said first and second reactive components of said first reaction system being reactable when brought into contact with one another to produce a colored mark;

the reactive material in the back coating of said first intermediate sheet comprising said microcapsules containing a first initially colorless reactive component of a second initially colorless reaction system;

the reactive material in the front coating of a second one of said intermediate sheets which is next adjacent to said first intermediate sheet comprising a second initially colorless reactive component of said second reaction system, said first and second reactive components of said second reaction system being reactable when brought into contact with one another to produce a colored mark;

the reactive material in the back coating of said second intermediate sheet comprising said microcapsules containing said first reactive component of said first reaction system, said first component of the first system being incapable of reacting with the second component of the second system to produce a colored mark and said first component of the second system being incapable of reacting with the second component of the first system to produce a colored mark; and the reactive material in the front coating of said bottom sheet comprising a mixture of said second components.

9. A set of sheets as set forth in claim 8 wherein there is included more than two of said intermediate sheets, all odd numbered intermediate sheets being the same as said first one thereof and all even numbered intermediate sheets being the same as said second one thereof.

* * * * *